US008932412B2

(12) United States Patent
Ferragut, II et al.

(10) Patent No.: US 8,932,412 B2
(45) Date of Patent: Jan. 13, 2015

(54) METHOD AND APPARATUS FOR AN APPLIANCE WITH A POWER SAVING MODE

(75) Inventors: Nelson J. Ferragut, II, Stevensville, MI (US); David W. Jiral, Saint Joseph, MI (US); Paul R. Johnson, Saint Joseph, MI (US); Waldemar Romanowski, Wroclaw (PL); Ryan K. Roth, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 840 days.

(21) Appl. No.: 13/171,820

(22) Filed: Jun. 29, 2011

(65) Prior Publication Data

US 2013/0000674 A1 Jan. 3, 2013

(51) Int. Cl.

| | |
|---|---|
| ***B08B 3/00*** | (2006.01) |
| ***A47L 15/46*** | (2006.01) |
| ***A47L 15/00*** | (2006.01) |

(52) U.S. Cl.

CPC ..... *A47L 15/46* (2013.01); *A47L 15/0047* (2013.01); *A47L 2301/08* (2013.01); *A47L 2501/36* (2013.01)

USPC ..... 134/57 D; 134/58 D; 713/323

(58) Field of Classification Search

USPC ..... 134/18, 42, 57 D, 58 D; 713/323

See application file for complete search history.

(56) References Cited

U.S. PATENT DOCUMENTS

| | | | | |
|---|---|---|---|---|
| 4,756,321 | A * | 7/1988 | Livingston et al. | 134/56 D |
| 5,073,943 | A | 12/1991 | Chapman | |
| 6,292,233 | B1 | 9/2001 | Erba et al. | |
| 6,760,578 | B2 | 7/2004 | Rotzoll | |
| 7,340,615 | B2 | 3/2008 | Krantz et al. | |
| 7,564,693 | B2 | 7/2009 | Liao et al. | |
| 2009/0153236 | A1 | 6/2009 | Kneepkens et al. | |
| 2010/0102832 | A1 | 4/2010 | Bartling et al. | |
| 2010/0177765 | A1 | 7/2010 | Kee | |

FOREIGN PATENT DOCUMENTS

| | | | |
|---|---|---|---|
| EP | 2056323 | A1 | 5/2009 |
| JP | 2003051960 | A | 2/2003 |

* cited by examiner

*Primary Examiner* — Saeed T Chaudhry

(57) ABSTRACT

A dishwasher configured to perform a physical cycle of operation and having a power savings mode during which the dishwasher periodically monitors a key press by a user to determine if the dishwasher should be taken out of the power savings mode.

14 Claims, 3 Drawing Sheets

METHOD AND APPARATUS FOR AN APPLIANCE WITH A POWER SAVING MODE

BACKGROUND OF THE INVENTION

Contemporary dishwashers have a wash chamber in which dishes and utensils are placed to be washed according to an automatic cycle of operation. Water, alone, or in combination with a treating chemistry, forms a wash liquid that is sprayed onto the dishes and utensils during the cycle of operation with a pump driven by an electric motor. The wash liquid may further be recirculated onto the dishes and utensils during the cycle of operation using a recirculation pump.

Dishwashers and household appliances in general may have a power savings mode (sometimes called a "sleep mode" of "off mode") where most of the dishwasher components, including a user interface or control panel, are powered down until a user requests the dishwasher to wake-up to perform a cycle of operation. Typically, this power up process is performed by a user pressing a key dedicated to "waking up" the dishwasher and putting it in a stand-by mode. The circuitry for detecting the key press must be on to determine if the key is pressed and as a result the dishwasher consumes power in keeping the detection circuit on continuously.

There has been a recent trend towards placing appliances in a power savings mode to achieve greater energy efficiency and reduce the cost of ownership of the appliance. There may be future mandates requiring power savings modes on appliance that result in very low power draw during appliance idle states. For example, Europe may put in place requirements of 0.5 Watts of power draw for appliances in a power savings mode by 2014.

SUMMARY OF THE INVENTION

An appliance for executing a physical cycle of operation that can selectively be placed in one of a first mode and a second mode wherein the second mode draws less power than the first mode. The appliance comprises a control panel comprising at least one user input interface that when activated generates a key press input signal, a controller communicatively coupled to the at least one user input interface to receive the key press input signal and having a clock producing a periodic clock signal, a timing circuit that receives the periodic clock signal and generates a strobe signal based on the periodic clock signal, and a detector logic circuit that detects the strobe signal and the key press signal when the appliance is in the second mode. The controller places the appliance in the first mode based on the detected strobe signal and key press signal.

DESCRIPTION OF EMBODIMENTS OF THE INVENTION

The invention relates to an appliance having a power savings mode or sleep mode and "waking up" the appliance from the power savings mode or sleep mode, and placing the appliance in a stand-by mode. More specifically, the appliance comprises a detector logic circuit that is in an "off" state for a portion of time and in an "on" or active state for a portion of time while the appliance is in the power savings mode. During the period of time when the detector logic circuit is in an active mode, it may detect a key press on a control panel by a user of the appliance and upon such detection, wake up the appliance and place the appliance in a stand-by mode. With this structure, the key press need not be a dedicated key for waking up the appliance.

Figure 1:
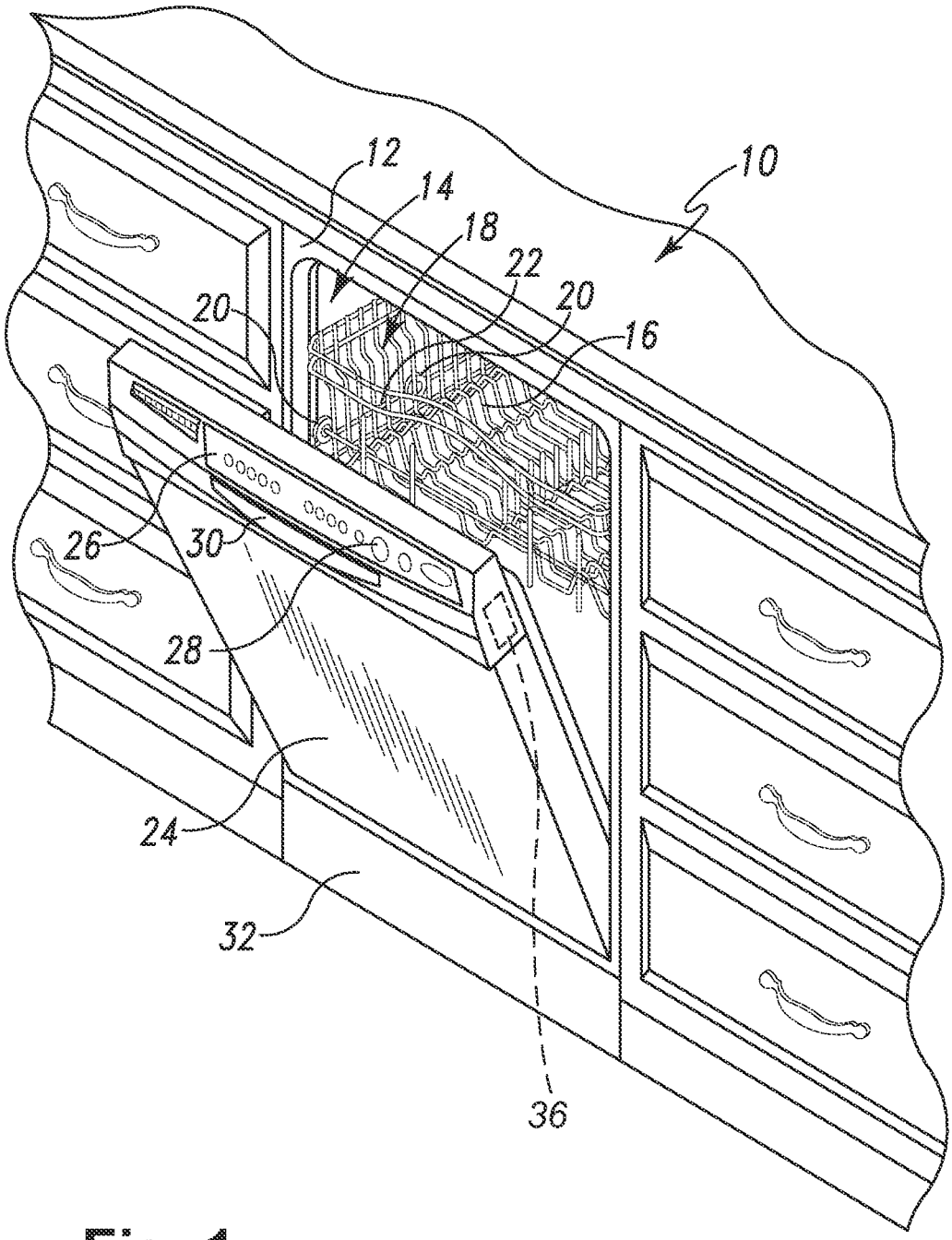
FIG. 1 is a schematic view of an appliance in the form of a dishwasher with an electronic controller configured to execute an appliance wake-up feature according to an embodiment of the current invention.

Referring to FIG. 1, one embodiment of the invention is shown in a dishwashing machine 10 (hereinafter dishwasher 10). The dishwasher 10 shares many features of a conventional automatic dishwasher, which will not be described in detail herein except as necessary for a complete understanding of the invention. While the present invention is described in terms of a conventional dishwashing unit, it could also be implemented in any type of appliance for executing a physical cycle of operation where a wake up apparatus is beneficial, such as in-sink dishwashers, multi-tub dishwashers, drawer-type dishwashers, clothes washers, clothes dryers, and the like.

The dishwasher 10 has a tub 12 that at least partially defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from and retract into the tub 12, which facilitates the loading and unloading of the dish racks 16. The roller assemblies 18 include a number of rollers 20 that move along a corresponding support rail 22.

A machine compartment 32 is located below the tub 12. The machine compartment 32 is sealed from the tub 12. In other words, unlike the tub 12, which is filled with fluid and exposed to spray during the wash cycle, the machine compartment 32 does not fill with fluid and is not exposed to spray during the operation of the dishwasher 10. The machine compartment 32 may house several electrical components (not shown) of the dishwasher 10 including, but not limited to, a recirculation pump assembly, drain pump, and various other motor(s), valve(s), and sensors along with the associated wiring and plumbing.

A door 24 is hinged to the lower front edge of the tub 12. The door 24 permits user access to the tub 12 to load and unload the dishwasher 10. The door 24 also seals the front of the dishwasher 10 during a wash cycle. A user input interface in the form of a control panel 26 is located at the top of the door 24. The control panel 26 includes a number of operational controls 28, such as buttons and knobs, dials, lights, switches, and displays enabling a user to input commands which are used by an electronic controller 36 to control the operation of the dishwasher 10. The electronic controller 36 is also commonly referred to as an appliance control unit (ACU) or the main appliance board. A handle 30 is also included in the control panel 26. The user may use the handle 30 to unlatch and open the door 24 to access the tub 12.

The electronic controller 36 is embedded within the door 24 of the dishwasher 10 and is communicatively coupled to various electrical components of the dishwasher 10 and the control panel 26 with operational controls 28 thereon and controls the various components of the dishwasher 10 to execute one or more cycles of operation. The electronic controller 36 can be located elsewhere, such as in the machine compartment 32.

Figure 2:
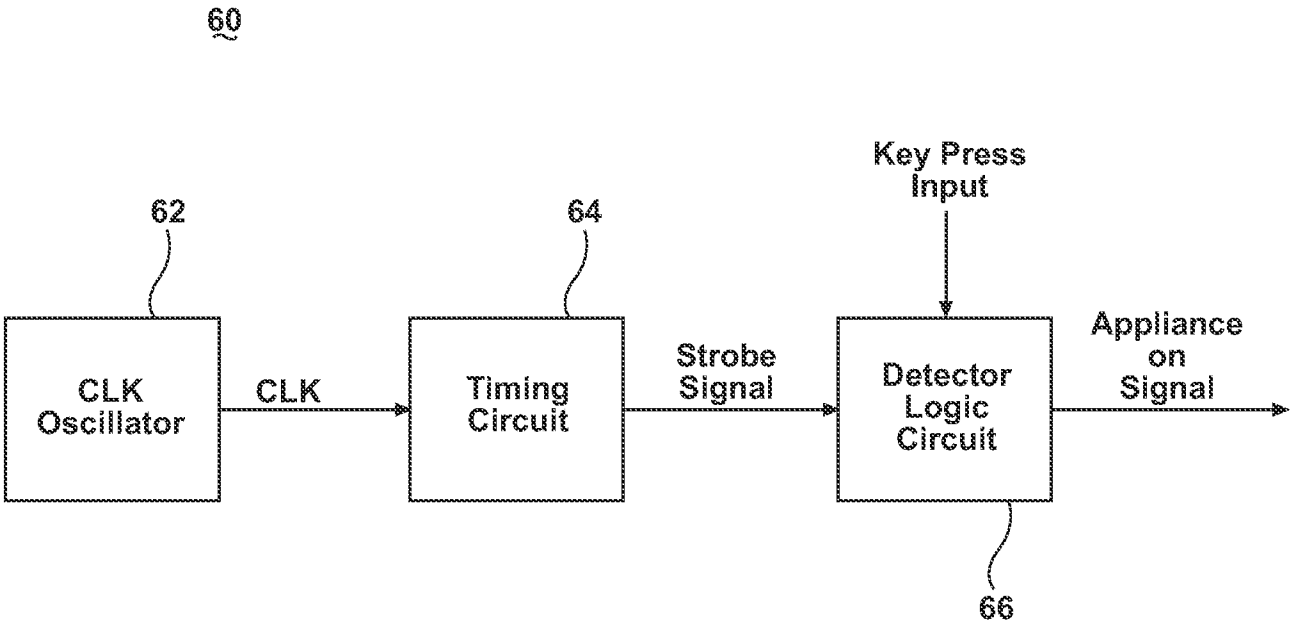
FIG. 2 is a block diagram of an appliance wake-up circuit according to an embodiment of the current invention implemented within the electronic controller of the dishwasher of FIG. 1.
Figure 3:
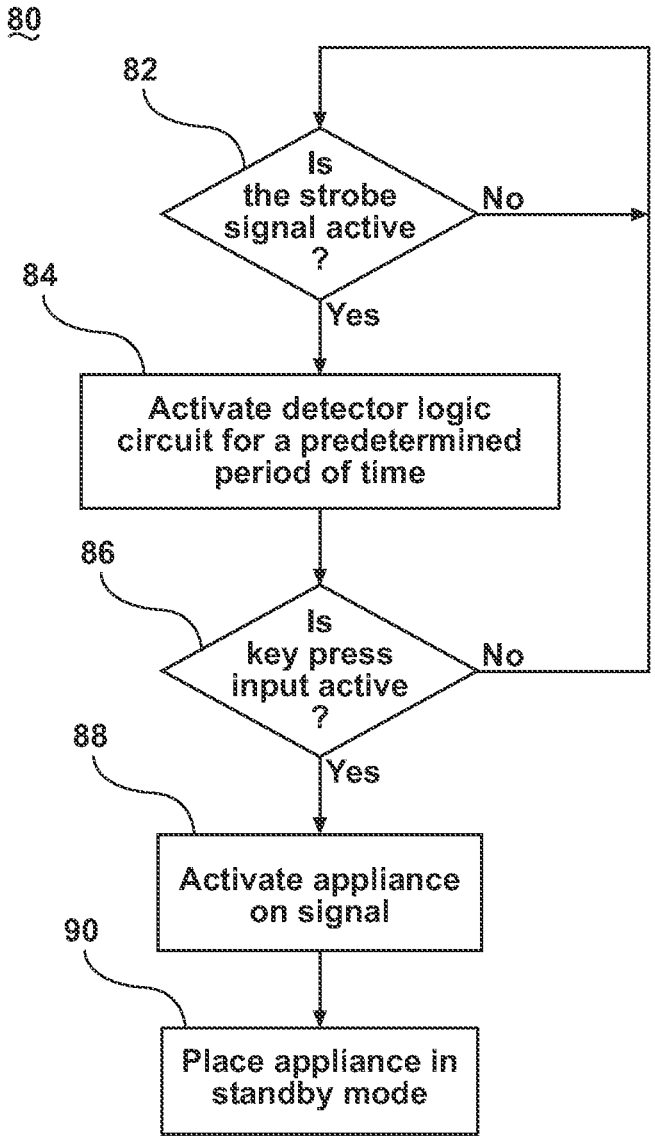
FIG. 3 is a flow diagram of the appliance wake-up method of the dishwasher of FIG. 1.

The electronic controller 36 further comprises circuitry to activate the dishwasher 10 to a first mode or a stand-by mode from a second mode or a power savings mode that draws less power than the first mode, and will be further described in conjunction with FIGS. 2 and 3. When the dishwasher is in a second mode or the power savings mode, total power consumption is preferably less than 0.5 Watts. In the first mode or the stand-by mode, the controller is ready to accept instruction from a user to operate the dishwasher according to one of several cycles of operation. In the stand-by mode, the total power consumption is normally greater than 0.5 Watts.

Referring now to FIG. 2, a wake-up circuit 60 in the electronic controller 36 that functions to transition the dishwasher 10 from the second mode to the first mode, is illustrated in block form. The wake up circuit 60 comprises a clock circuit 62, a timing circuit 64, and a detector logic circuit 66.

The clock circuit 62 generates a periodic clock signal (CLK) with periodic transitions resulting in a fixed clock frequency. The clock circuit 62 may be any known clock producing circuit or method including, but not limited to, a crystal oscillator or a voltage controlled monostable multivibrator. The exact implementation of the clock circuit 62 does not detract from the embodiment of the invention discussed herein. The CLK frequency may be any value and may preferably be in the range of 10 kilohertz (kHz) to 100 megahertz (MHz), and more preferably between 100 kHz and 1 MHz.

The CLK from the clock circuit 62 is received by the timing circuit 64 and the timing circuit 64 uses the CLK to generate a strobe signal. The strobe signal is a signal that is activated for a predetermined strobe active time with a periodicity of a predetermined strobe period. In other words, the strobe signal has a period, defined by the predetermined strobe period, and a duty cycle defined by the portion of time that the strobe signal is active, defined by the predetermined strobe active time, during the period. Therefore, the duty cycle of the strobe signal is the predetermined strobe active time divided by the predetermined strobe period. The predetermined strobe active time may be up to 3 seconds, preferably between 50 milliseconds and 1 second, and more preferably 0.1 seconds. The predetermined strobe period may be up to 15 seconds, preferably up to 10 seconds, and more preferably 4.75 seconds. As an example, if the predetermined strobe period is 4.75 seconds and the predetermined strobe active time is 0.25 seconds, then the strobe signal duty cycle is 5.3%.

Both the predetermined strobe period and the predetermined strobe active time may be integer multiples of the CLK period. For example, if the CLK frequency is 1 kHz, resulting in a CLK period of 1 millisecond, and the predetermined strobe active time is 0.25 seconds and the predetermined strobe period is 4.75 seconds, then the predetermined strobe active time is 250 times the CLK period and the predetermined strobe period is 4,750 times the CLK period.

The timing circuit 64 as part of the electronic controller 36 generates the strobe signal based on the CLK. The timing circuit 64 may be implemented as an integrator-comparator circuit, where the CLK is integrated using commonly known methods, such as by using an operational amplifier with input CLK, and then comparing the integrator output using a comparator against a reference voltage corresponding to the predetermined strobe period. In such an implementation the output of the comparator will have a period of the predetermined strobe period. The output of the comparator may further be latched by known techniques, such as by use of a flip flop, for the predetermined strobe active time. An alternative implementation of the timing circuit 64 may be by using one or more registers that count the number of CLK transitions and logic circuits that provide the strobe signal output based on the register values, where the register value counts the multiple of the CLK period that has elapsed since the register is reset. Therefore, by counting the CLK multiples and by knowing the integer multiple of the CLK corresponding to both of the predetermined strobe active time and the predetermined strobe period, the logic circuit may generate the strobe signal. Although two potential implementations of the timing circuit are discussed herein, any known implementation may be used to generate a desired strobe signal based on the CLK. The exact implementation of the timing circuit 64 does not detract from the embodiment of the invention discussed herein.

The strobe signal from the timing circuit 64 is provided to the detector logic circuit 66. Additionally, the detector logic circuit 66 is provided with a key press input corresponding to a user depressing one of the operational controls 28 on the control panel 26. In other words, when a user depresses one of the operational controls 28, the key press input is activated. Based on both the strobe signal and the key press input, the detector logic circuit 66 generates an "appliance on" signal. The "appliance on" signal, when active, places the dishwasher in the first mode and, when not active, keeps the dishwasher 10 in the second mode.

When the strobe signal is activated, the detector logic circuit 66 turns on or is active and conversely, when the strobe signal is not activated, the detector circuit 66 is not on or is not active. For example, if the strobe signal has a predetermined strobe period of 4.75 seconds and a predetermined strobe active time of 0.25 seconds, then the detector logic circuit 66 will be turned on for 0.25 seconds every 4.75 seconds, having a duty cycle of 5.3%. Continuing with this example, when the dishwasher 10 is in a second mode or a power saving mode, the detector logic circuit 66 is on 5.3% of the time and off 94.7% of the time.

When the detector logic circuit 66 is in an "on" state, it can detect if the key press input is active. If the detector logic circuit is in an "off" state, then it cannot detect if the key press input is active. If the detector logic circuit 66 detects that the key press input is active, then it activates the "appliance on" signal and thereby places the dishwasher 10 in a stand-by mode.

When the detector logic circuit 66 is off, it draws little or no power and the other electrical components of the dishwasher 10 are also in an "off" state and therefore also draw negligible power. However, when the detector logic circuit 66 is in an "off" state, the clock circuit 62 and timing circuit remain on and draw power, but the power draw of these circuits is relatively low and at most 0.1 Watts. As a result, if the duty cycle for the detector logic circuit 66 is small, such as less than 20% of normal, then the power draw of the dishwasher 10 may be relatively low while the dishwasher 10 is in the power savings mode at less than 0.5 Watts.

The detector logic circuit 66 may be implemented using logic gates that are activated when the strobe signal is high, logic elements that detect the key press input, and finally latch or flip flop for holding an active state of the appliance on signal. The exact implementation of the detector logic circuit 66 does not detract from the embodiment of the invention discussed herein.

Referring now to FIG. 3, a method 80 of toggling the dishwasher 10 from the second mode to the first mode by the wake up circuit 60 is shown. At 82 it is determined if the strobe signal is active. If the strobe signal is not active, then the strobe signal continues to be monitored. If, however, the strobe signal is found to be active at 82, then the detector logic circuit 66 is activated for the predetermined strobe active time at 84. While the detector logic circuit 66 is turned on, it determines if the key press input is active at 86. If the key press input is not active, then the method 80 returns to monitoring the strobe signal at 82. If, however, the key press input is found to be active at 86, then the detector logic circuit 66 activates the appliance on signal at 88 and, as a result, places the appliance in the first mode at 90.

In the discussion herein when a signal is active it can mean that the signal is in a high or logic "1" state or a low or logic "0" state. Additionally, some signals may be considered active in one logic state and other signals may be considered active in the other logic state. For example, the strobe signal may be active when it is high and the key press input may be active when it is a logic zero. The exact logic designation of active for each of the various signals does not detract from the embodiment of the invention disclosed herein and the embodiment encompasses all logical and Boolean equivalents of the circuits and signals discussed.

It can be seen that the wake up circuit 60 and the associated method 80 provides for an appliance such as the dishwasher to be in a second mode, or a power savings mode, where almost all of the components of the dishwasher 10 are in an "off" state. Therefore, the dishwasher 10 consumes very little power while in the power savings mode. In particular, the clock circuit 62 and the timing circuit 64 are on continuously and the detector logic circuit 66 is on intermittently while the dishwasher 10 is in the power savings mode. When the detector logic circuit 66 is on it can detect a key press by a user of one of the operational controls 28 of the control panel 26. However, since the detector logic circuit is only on intermittently while the appliance is in the power savings mode, the user may have to press and hold one of the operational controls 28 until the detector logic circuit 66 turns on to detect the key press. It may be observed that there is a trade-off in terms of power consumption and user experience. On one hand, if the detector logic circuit 66 turns on very infrequently, then the power consumed by the detector logic circuit 66 and the dishwasher in general may be reduced. However, that may lead to user dissatisfaction in having to press and hold the operational control 28 for a relatively long time. Therefore, the predetermined strobe active time and predetermined strobe period may be chosen to both provide user satisfaction, as well as, power savings. For example, if the predetermined strobe active time is 0.25 seconds and the predetermined strobe period is 4.75 seconds, then the user has to press and hold one of the operational controls 28 for at most 4.75 seconds before the detector logic circuit 66 detects the key press. This may be an acceptable wait time for a user of the appliance. At the same time, the detector logic circuit 66 is in an off state for 94.7% of the time, resulting in considerable power savings. The circuit 60 and method 80 disclosed can be used to achieve power consumption in the power savings mode of 0.5 Watts or less.

Another advantage of the present invention is that a dedicated "on" switch with a dedicated wake up circuit is not required. Therefore, the present invention may provide environmental benefits by way of energy savings, cost benefits, and potential aesthetic benefits on the control panel 26.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An appliance for executing a physical cycle of operation wherein the appliance can be placed in one of a first mode or a second mode that draws less power than the first mode comprising:

a control panel having at least one user input interface that, when activated, generates a key press input signal; and a controller communicatively coupled to the at least one user input interface to receive the key press input signal and having a clock circuit that is on when the appliance is in the second mode and generates a periodic clock signal; a timing circuit that is on when the appliance is in the second mode and receives the periodic clock signal and generates a periodic strobe signal based on the periodic clock signal, and a detector logic circuit that is periodically on when the appliance is in the second mode based on the periodic strobe signal;

wherein the detector logic circuit is configured to detect the key press input signal when the periodic strobe signal is active and, when the key press input signal is detected, generates a signal that places the appliance in the first mode.

2. The appliance of claim 1 wherein the appliance is a dishwasher.

3. The appliance of claim 1 wherein the timing circuit activates the strobe signal for a predetermined strobe active time.

4. The appliance of claim 3 wherein the predetermined strobe active time is 3 seconds or less.

5. The appliance of claim 4 wherein the predetermined strobe active time is 0.1 second.

6. The appliance of claim 3 wherein the strobe signal has a periodicity equal to a predetermined strobe period.

7. The appliance of claim 6 wherein the predetermined strobe period is 10 seconds or less.

8. The appliance of claim 7 wherein the predetermined strobe period is 4.75 seconds.

9. The appliance of claim 6 wherein the predetermined strobe active time and the predetermined strobe period are both integer multiples of the period of the periodic clock signal.

10. The appliance of claim 1 wherein the detector logic circuit is turned on only when the strobe signal is active.

11. The appliance of claim 1 wherein the controller places the appliance in the first mode when both the strobe signal and the key press signal are active.

12. The appliance of claim 1 wherein electrical components of the appliance are not provided electrical power except for the controller when the appliance is in the second mode.

13. The appliance of claim 1 wherein the appliance consumes at most 0.5 Watts of power when in the second mode.

14. The appliance of claim 1 wherein the appliance consumes greater than 0.5 Watts of power when in the first mode.

* * * * *